US006138632A

United States Patent [19]

Nakase

[11] Patent Number: 6,138,632

[45] Date of Patent: Oct. 31, 2000

[54] PUMP CONTROL FOR SMALL WATERCRAFT

[75] Inventor: Ryoichi Nakase, Hamamatsu, Japan

[73] Assignee: Sanshin Kogyo Kabushiki Kaisha, Hamamatsu, Japan

[21] Appl. No.: 08/940,048

[22] Filed: Sep. 30, 1997

Related U.S. Application Data

[62] Division of application No. 08/811,255, Mar. 4, 1997, Pat. No. 5,732,672, which is a continuation of application No. 08/450,565, May 25, 1995, abandoned.

[30] Foreign Application Priority Data

May 27, 1994 [JP] Japan ..... 6-115525

[51] Int. Cl.[7] ..... F01M 1/00

[52] U.S. Cl. ..... 123/196 M; 123/196 R; 440/88

[58] Field of Search ..... 440/88; 123/196 R, 123/196 M, 196 V, 73 AD, 196 S

[56] References Cited

U.S. PATENT DOCUMENTS

| | | | |
|---|---|---|---|
| 3,827,417 | 8/1974 | Morita . | |
| 3,999,531 | 12/1976 | Taylor . | |
| 4,059,086 | 11/1977 | Tsubouchi . | |
| 4,697,553 | 10/1987 | Lie . | |
| 4,890,695 | 1/1990 | Morris et al. . | |
| 4,893,598 | 1/1990 | Stasiuk . | |
| 4,940,114 | 7/1990 | Albrecht . | |
| 5,149,287 | 9/1992 | Koike . | |
| 5,195,481 | 3/1993 | Oyama et at al. . | |
| 5,419,271 | 5/1995 | Tweet et al. | 114/183 R |
| 5,582,529 | 12/1996 | Montgomery | 441/74 |
| 5,732,672 | 3/1998 | Nakase | 23/196 R |
| 5,881,664 | 3/1999 | Suganuma | 114/183 R |

*Primary Examiner*—John Kwon
*Attorney, Agent, or Firm*—Knobbe, Martens, Olson & Bear LLP

[57] ABSTRACT

A lubricant supply system is provided for the induction system of a marine propulsion engine. The lubricant supply system delivers lubricant to the a flow controlling valve in the induction system upon shutting down of the engine and can be operated manually at the discretion of a user. The lubricant serves to reduce the likelihood of post-operation corrosion of the valve, particularly at the sliding support surfaces of the valve and also provides lubricant from startup operation.

3 Claims, 3 Drawing Sheets

PUMP CONTROL FOR SMALL WATERCRAFT

CROSS REFERENCE TO RELATED APPLICATIONS

This application is a divisional of U.S. patent application Ser. No. 08/811,255, filed Mar. 4, 1997, now U.S. Pat. No. 5,732,672 which is a file wrapper continuation of U.S. patent application Ser. No. 08/450,565, filed May 25, 1996, now abandoned.

BACKGROUND OF THE INVENTION

This invention relates to a control for a small watercraft and more particularly to a control for a pump such as a lubricating pump for such watercraft.

As is well known, marine propulsion engines that are utilized in various types of watercraft are subject to problems in conjunction with possible corrosion. This is particularly true with regard to engines operable in salt water environments.

One area where corrosion can be a problem is in the flow controlling valves positioned in the induction system of the engine, such as the choke valve and throttle valve. These valves are normally of the butterfly-type, but in any event have a sliding support within the body of the induction system. Frequently the valve is positioned in an area which is downstream of the fuel supply and hence the valve and its sliding support tends to be washed of lubricant by the fuel during operation of the engine. As a result, when the engine is shut off, the sliding or rotating surfaces are relatively dry. This situation creates the possibility of post-operation corrosion, which makes operation of these valves difficult when the engine is next started.

It is therefore a principal object of this invention to provide an improved lubricant supply system for an engine.

It is a further object of this invention to provide a lubricant supply system for an engine wherein the lubricant is supplied so as to lubricate the flow controlling valves of the induction passage.

It is a further object of this invention to provide an improved arrangement for reducing the likelihood of post-operation corrosion of the flow controlling valves of an engine induction system.

Furthermore, the flow of fuel, air and exhaust gases tends eventually to wash upper-end engine components of lubricant during extended operation. Thus, in addition to the flow control valves of the induction system, it frequently is desirable to provide a supply of lubricant to the engine such that the engine is in a lubricated condition after operation. Such lubrication is frequently done when the engine will be out of service for a long time interval. Normally this is done by removing the spark plugs after operation and pouring oil into the cylinder bores in small amounts. Alternatively, the lubricant may be added through the induction system and will pass to the parts of the engine when cranking next occurs. However, these procedures are cumbersome and, therefore, frequently are ignored.

It is, therefore, a still further object of this invention to provide an arrangement for supplying lubricant to an engine for maintaining post operation lubrication.

It is a still further object of this invention to provide an improved pump control for a small watercraft for controlling an electrically-operated pump such as the lubricating pump for an engine.

SUMMARY OF THE INVENTION

This invention is a adapted to be embodied in a small watercraft and more particularly to an improved control arrangement for a small watercraft. The small watercraft has a hull having a generally open passenger compartment adapted to accommodate at least one rider operator seated behind a handlebar control for controlling at least the steering of the watercraft. The watercraft further includes an electrically-operated pump positioned in an engine compartment of the hull. A control switch for the pump is located on the handlebar assembly adjacent at one end thereof.

DETAILED DESCRIPTION OF THE PREFERRED EMBODIMENTS OF THE INVENTION

Figure 1:
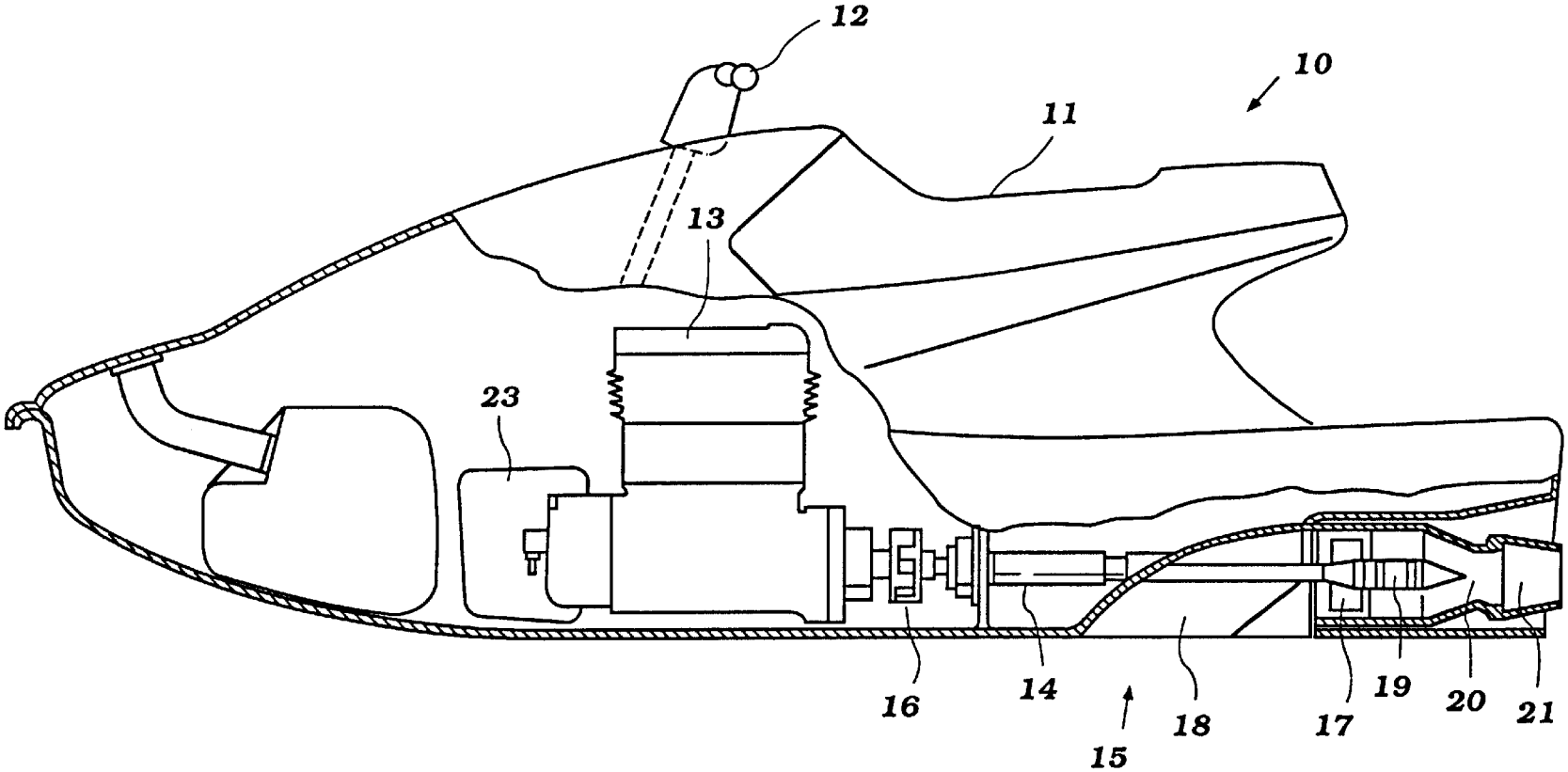
FIG. 1 is a cross-sectional side view of a watercraft operable in marine environments.

Referring now in detail to the drawings and initially primarily to FIG. 1, a motorized watercraft is shown in cross-section and identified generally by the reference numeral 10. The watercraft 10 may be one of several different designs. The preferred embodiment shown is a personal watercraft which may be ridden in straddle fashion by one person or two people in tandem. The operator may sit or stand over a seat 11 and grasp a handle 12 for support and to operate controls of the watercraft 10. It will be understood that this illustration and description is given only to permit those skilled in the art to understand the environment in which the invention has particular utility.

The watercraft 10 is powered by an engine 13 which in the preferred embodiment is attached to an impeller shaft 14 of a jet propulsion unit 15 by way of a flexible coupler 16. The impeller shaft 14 drives an impeller having a plurality of blades 17. The rotating blades 17 draw water into a water intake channel 18. The water is discharged past a plurality of straightening vanes 19, through a discharge nozzle 20, and through a pivoted steering nozzle 21. The resulting movement of water through and to the rear of the watercraft 10 propels the watercraft 10 forwardly in a direction controlled by the pivotal position of the steering nozzle 21. The steering nozzle 21 may be controlled by the user by steering the handle 12 of the watercraft 10.

FIG. 1 also illustrates a water trap 23. It is preferable to employ such a water trap 23 in motorized watercraft in order prevent water, which floods the exhaust tail pipe (not shown) when the watercraft is capsized, from reaching the engine. In the event of such flooding, water must fill the water trap 23 before the water can reach the engine 13 through the exhaust system, as is known in this art. The water trap 13 is chosen to be of a suitable volume to prevent flooding of the engine.

Figure 2:
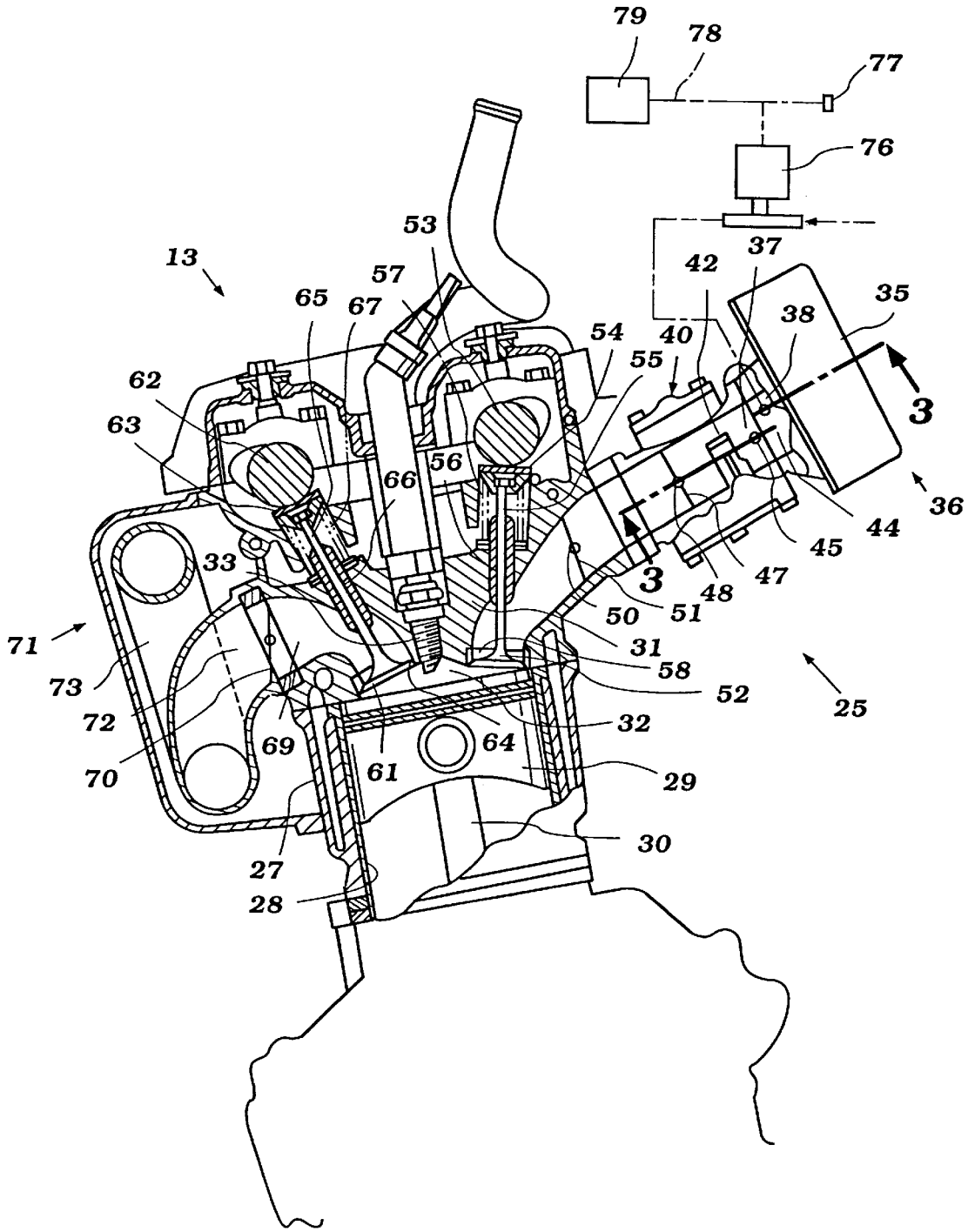
FIG. 2 is a partial cross-sectional view of a marine propulsion engine constructed in accordance with an embodiment of the invention, showing the induction and exhaust systems of one cylinder.

Referring now to FIG. 2, the engine 13 constructed in accordance with the preferred embodiment of the invention is illustrated partially and in cross-section. In the illustrated embodiment, the engine 13 is of a two-cylinder, in-line type and operates on a four-stroke principle. It will be readily apparent to those skilled in the art how the invention may be employed with internal combustion engines having other arrangements, such as different cylinder numbers and combustion principles. Since the invention relates primarily to a lubricating system for the engine 13, only a partial cross-sectional view through one cylinder of the engine 13 is necessary to understand the invention.

The engine 13 is comprised of a cylinder block, indicated generally by the reference numeral 27, in which one or more cylinder bores 28 are formed. A piston 29 reciprocates in each cylinder bore 28 and is connected to the upper end of a connecting rod 30, which is journalled on a crankshaft. The crankshaft, in turn, is rotatably journalled within a crankcase chamber. Since the details of the crankshaft and crankcase chamber interrelationship are not necessary to an understanding of the invention, however, they are not illustrated and will not be discussed in detail.

A cylinder head 31 is affixed to the cylinder block 27 in a known manner and cooperates with each cylinder bore 28 and piston 29 to form the combustion chambers 32 of the engine 13. A plurality of spark plugs 33 (one for each cylinder) is mounted in the cylinder head 31, each in registry with the combustion chamber 32 for firing a charge therein. The spark plugs 33 are fired by any suitable type of ignition system.

The induction system 25 of the engine 13 supplies the charge to the combustion chamber 32 of each cylinder. The induction system includes an air intake device 35 which defines an upstream end 36 of an induction passage 37 and which gathers air into the induction system 25 during engine operation. The air then passes a lubricant supply adaptor 38 of the present invention, which is interposed between the air intake device 35 and a charge former 40 within the induction passage 37. The charge former 40, in the preferred embodiment, takes the form of a carburetor 40 which forms a charge by mixing fuel and air within the induction passage 37. Although other charge-forming arrangements may be employed, the invention has particular utility in conjunction with charge formers which have or cooperate with flow-controlling valves.

The preferred embodiment includes a separate carburetor 40 for each cylinder, in a manner well-known to one of skill in this art. Thus, an air intake device 35 supplies air to each induction passage 37 and separate lubricant supply adaptors 38 which are each situated upstream of one of the carburetors 40. The invention, however, may readily be adapted to an engine of the type having only one carburetor for both cylinders (or all cylinders where more than two are present), as will be understood by one skilled in the art. The single carburetor of such an engine would supply fuel/air mixture to all of the cylinders, in a known manner.

A boost venturi 42 is provided in the carburetor 40, downstream of the lubricant supply adaptor 38, for providing the main fuel charge to the induction system 25. The venturi 42 communicates with a main fuel discharge circuit of the carburetor 40. In addition, normal idle and transition circuits may also be provided.

A flow-controlling valve in the form of a choke valve 44 is interposed between the lubricant supply adaptor 38 and the boost venturi 42 within the induction passage 37. In the illustrated embodiment, the choke valve 44 is of the butterfly type, slidably supported by a choke valve shaft 45 which is journalled in the walls of the carburetor 40. When the choke valve shaft 45 is caused to slide rotatably within the passage 37 walls, the choke valve 44 opens and closes accordingly. The choke valve 44 may, however, be of a piston or slide type, in which case a piston or slide valve is selectively caused to slide into the induction passage 37, thereby closing the valve 44. In either case, the choke valve 44 may be suitably switched manually or automatically between its open and closed positions.

Downstream of the boost venturi 42 there is provided a flow-controlling throttle valve 47, which may be selectively controlled remotely by an operator of the watercraft 10. The throttle valve 47 is again preferably of a butterfly type, although it may also be of a piston or slide type. The butterfly-type throttle valve 47 is supported on a throttle valve shaft 48, which is in turn journalled in the walls of the carburetor 40.

During operation, the carburetor 40 forms a fuel-air charge from the air gathered at the air intake device 35 and the fuel entering the induction system 25 at the boost venturi 42. This charge passes the throttle valve 47, at the discretion of the operator of the watercraft 10, and continues downstream through the induction passage 37.

Because the illustrative environment for the invention is a personal watercraft 10, the preferred embodiment includes a gravity assisted induction valve 51, also of a butterfly type supported by a valve shaft 50, downstream of the throttle valve 44 within the induction passage 37. The gravity assisted valve 51 is sensitive to the orientation of the watercraft 10 in a known manner, so that if the watercraft 10 should be upset, the valve 51 closes to prevent water from passing through the induction passage 37 to the remainder of the engine 13.

Under normal operation, however, the charge passes through the open gravity assisted induction valve 51 to an intake valve 52 of the combustion chamber 32. The intake valve 52, driven by an intake camshaft 53 which is in turn driven by the crankshaft in any known manner, opens and closes according to four-stroke principles. The camshaft 53 alternately actuates an intake tappet follower 54. The tappet 54 sheaths the upper end of an intake valve stem 55, which is slidably supported by an intake valve guide 56. An intake valve spring 57 forces the tappet follower 54 onto the surface of the camshaft 53 as the camshaft 53 rotates, closing the valve.

The rotation of the camshaft 53 moves the tappet 54, the valve stem 55, and thus the valve 52 itself, downward, causing the intake valve 52 to unseat from an intake valve seat 58. Substantially simultaneously, the piston 29 withdraws within the cylinder bore 28, drawing the fuel-air charge through the intake valve and into the combustion chamber 32. The piston 29 compresses the charge within the chamber 32 when the intake valve 52 is closed. The spark plug 33 when fired then causes the compressed charge to burn and expand within the combustion chamber 32, driving the piston 29 downward.

Momentum of the crankshaft, transferred through the connecting rod 30, forces the piston 29 upwardly to discharge the combustion products through an exhaust valve 61. The exhaust valve 61 operates on the same principle as the intake valve 52. That is, the exhaust camshaft 62, driven from the crankshaft, alternately pushes down on an exhaust tappet follower 63, causing the exhaust valve 61 to unseat from an exhaust valve seat 64 as an exhaust valve stem 65 slides downward, movably supported by an exhaust valve guide 66. An exhaust valve spring 67 forces the tappet follower 63 onto the surface of the exhaust camshaft 62 as the camshaft 62 rotates, drawing the valve 61 back to the exhaust valve seat 64, thus closing the valve 61.

The exhaust gases travel through an exhaust passage 69 to a gravity assisted exhaust valve 70 which operates in a similar fashion to the gravity assisted valve 51 on the intake side. When the watercraft 10 is not capsized, this valve 70 is open, allowing exhaust gases to enter an exhaust manifold 71, which includes a downward sloping portion 72 and an upward sloping portion 73 which terminates at the water trap 23. The V-like dip in the exhaust manifold 71 thus-acts as a water trap itself, keeping water from seeping into the engine, especially when the watercraft 10 is idle.

It should be readily apparent that the induction system 25 will generally induct air containing a large amount of water vapor regardless of any precautions, due to operation of the watercraft 10 in a body of water. Additionally, the fuel flowing from the boost venturi 42 and other discharge circuits of the carburetor 40 will tend to wash the throttle valve 47, the throttle valve shaft 48 and its bearing surfaces of any lubricant there may have been before operation. The rapid flow of wet air during the operation of the watercraft 10 also tends to wash to choke valve 44 of any lubricant, while fuel, air and exhaust gas flow washes upper-end components of the engine 13 of lubricant.

Thus, when the engine is shut off, any minerals that may be contained in the water entering the induction system 25 will condense directly on the throttle valve shaft 48, as well as on the choke valve shaft 45. As a result, the throttle valve shaft 48 and choke valve shaft 45 are subject to corrosion while the engine 13 is shut down, which raises the possibility that the valves 44, 47 will seize up the next time the engine 13 is started. Additionally, the piston 29 may become dry of lubricant during operation, generating heat and damaging the walls of the cylinder bore 28.

Figure 3:
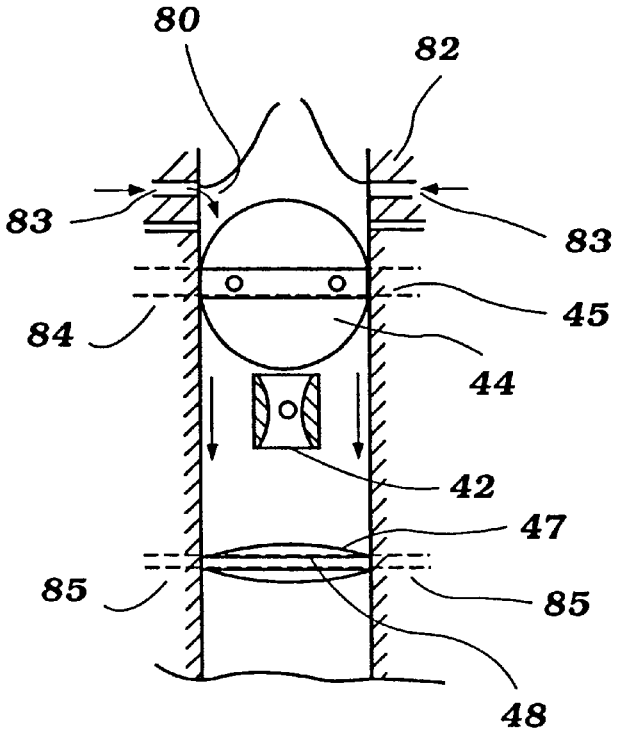
FIG. 3 is an enlarged cross-sectional view of a portion of an induction system of the marine propulsion engine, taken along line 3—3 of FIG. 2.

In order to prevent this problem and to provide lubricant to the cylinder for the next start-up operation, a lubricant supply system of the present invention is provided. This now will be described with respect to FIGS. 2 and 3.

Figure 4:
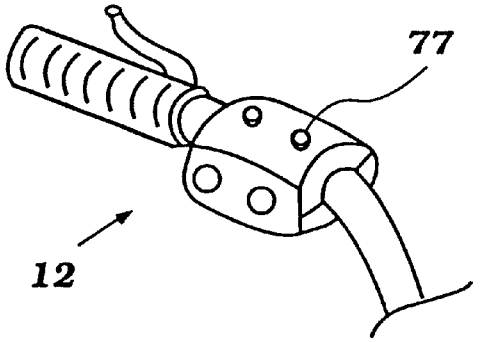
FIG. 4 is an enlarged view of a handle of the watercraft of FIG. 1 having user controls for operation of the watercraft.

The lubricant supply system comprises a lubricant pump 76, a switch 77 for activating the pump 76, and the lubricant supply adaptor 38 positioned within the induction passage 37, upstream of the carburetor 40. In the preferred embodiment, the switch 77 takes the form of a button 77 on the handle 12 of the watercraft 10, shown in FIG. 4, and may be manually triggered by the watercraft operator. This allows the user to selectively operate the lubricant supply system.-when shutting the engine 13 down for long periods of time. FIG. 4 also shows other controls which may be configured to actuate engine ignition, throttle valve control, or other functions for controlling the watercraft 10, as is known in this art.

The switch 77 is preferably connected electrically to the lubricant pump 76, although it may be mechanically connected without departing from the spirit of the present invention. In the preferred embodiment, the switch 77 is also electrically connected to an ignition circuit 78, which is in turn connected to a starter motor 79 of the engine 13. The lubricant pump 76 may be of any suitable type known in the art. It may receive lubricant from the main lubricant reservoir of the engine 13, such as the oil tank of a dry sump engine. Alternatively, lubricant may be supplied from the crankcase of a wet sump engine.

Activating the switch 77 causes the lubricant pump 76 to operate and deliver a quantity of lubricant 80, preferably oil 80, to the lubricant supply adaptor 38. The electrical circuitry connecting the switch 77 to the lubricant pump 76 preferably activates the pump 76 only temporarily so that an adequate quantity of oil 80 is delivered to the lubricant supply adaptor 48. In the preferred embodiment, the circuitry connects to the starter motor 79 via the ignition circuit 78 for running the engine 13 temporarily as well, allowing lubrication of the piston 29 within the cylinder bore 28. Both the engine and the lubricant pump 76 are allowed to run for a short time (e.g., 10 seconds), enough to allow lubricant to both lubricate the valves 44 and 47 and to get carried by flowing fuel-air to the piston 29 and other upper-end components.

It will be understood by one skilled in this art, however, that the connecting circuitry may be arranged to operate the lubricant pump 76 and engine 13 continuously while the manual switch 77 is depressed. When the switch 77 is released by the user, both the pump 76 and the engine 13 stop running. The circuitry may also be arranged to prohibit operation of the pump 76 while the engine operates, allowing the lubricant supply system to operate only after the engine 13 has been shut down, preventing burn out of the starter motor 79. These alternative circuits will be understood by one of skill in this art.

In the alternative, the lubricant supply system may only operate the lubricant pump 76, the switch 77 having no connection to the starter motor 79. In this case, oil is supplied to the choke valve 44 and the throttle valve 47 and sufficient oil is supplied to allow lubrication of the piston 29 within the cylinder upon restarting. Upon ignition and operation of the engine 13, the remaining oil in the induction system passes to the cylinder to lubricate the piston 29 and other upper-end components.

The lubricant supply adaptor 38 preferably comprises an adaptor plate 82 having two discharge apertures 83 opening into the induction passage 37 upstream of the carburetor 40. It will be understood that other numbers of apertures may also be employed for the invention to operate as contemplated. In the preferred embodiment, since there is a carburetor 40 for each of the two cylinders, there is accordingly provided a lubricant supply adaptor 38 for each of the two carburetors 40.

The discharge apertures 83 are positioned so that the oil 80 delivered through them flows to the moving parts of the flow-controlling valves 44 and 47. In the preferred embodiment, wherein butterfly-type valves are employed, the oil 80 flows downstream along the walls of the induction passage 37 to a pair of shaft joints 84 at which the choke valve shaft 45 is journalled within the walls of the carburetor 40. There the oil may seep into the joints 84 and lubricate the sliding surfaces of the shaft 45 and its bearings.

Sufficient oil is be supplied to allow further flow of oil 80 to a pair of shaft joints 85 of the throttle valve shaft 48, so that the throttle valve shaft 48 and bearings are similarly lubricated. In the preferred embodiment, temporary operation of the engine 13 also allows lubricant 80 to flow to the piston 29 and other upper-end components along with flowing fuel-air charge. Such engine lubrication is acheived simply by actuating the manual switch 77 after engine operation, rather than by cumbersome removal of the spark plugs 33 and manually pouring lubricant into the cylinder bores 23.

Thus, the moving parts of the flow-controlling valves 44, 47 are lubricated and protected against corrosion while the engine 13 is not in operation, assuring smooth operation of these valves 44, 47 when the engine 13 is next started. Additionally, lubrication is supplied to the piston 29 and upper-end components of the engine 13 for lubricated start-up.

It should be readily apparent that the described system may be utilized not only in conjunction with carbureted engines, but also with engines that are fuel injected, either direct or manifold, as long as they have a flow-controlling throttle valve in the induction passage. Of course, if a fuel injection system is employed and fuel is injected upstream of the throttle valve, the same problems with fuel washing will be present as they are with carburetors. Even if the injector is not positioned in the manifold upstream of the flow-controlling throttle valve, the corrosion problem still may exist.

In addition to these variations, the invention may also be employed in a number of different environments than that disclosed, which represents only a preferred embodiment of the invention. Such changes and modifications may be made without departing from the spirit and scope of the invention, as defined by the appended claims.

What is claimed is:

1. A small watercraft comprised of a hull defining a generally open passenger's area having a seat disposed above an engine compartment formed within said hull, an engine within said engine compartment for powering said small watercraft, said seat being adapted accommodate at least a single rider therein, a handlebar assembly positioned forwardly of said seat for controlling at least the steering of said watercraft, an electrically-operated pump contained within said engine compartment for pumping a lubricant for said engine, and a control for controlling the operation of said pump disposed on said handlebar assembly.

2. A small watercraft as set forth in claim 1, wherein the handlebar assembly has a pair of handgrips disposed at the ends thereof and the pump control is disposed adjacent one of said handgrips.

3. A small watercraft as set forth in claim 2, further including other controls for operation of the watercraft disposed adjacent said pump control on said handlebar assembly.

* * * * *